US005904598A

United States Patent [19]

Yamanashi

[11] Patent Number: 5,904,598

[45] Date of Patent: May 18, 1999

[54] CONNECTOR COUPLING STRUCTURE

[75] Inventor: Makoto Yamanashi, Shizuoka, Japan

[73] Assignee: Yazaki Corporation, Tokyo, Japan

[21] Appl. No.: 08/911,142

[22] Filed: Aug. 14, 1997

[30] Foreign Application Priority Data

Aug. 30, 1996 [JP] Japan ..... 8-230568

[51] Int. Cl.[6] ..... H01R 13/502

[52] U.S. Cl. ..... 439/701; 439/354

[58] Field of Search ..... 439/701, 717, 439/350, 354, 357

[56] References Cited

U.S. PATENT DOCUMENTS

| | | | |
|---|---|---|---|
| 3,848,951 | 11/1974 | Michaels et al. | 439/717 |
| 5,051,100 | 9/1991 | Kato et al. | 439/140 |
| 5,320,555 | 6/1994 | Okabe | 439/354 |
| 5,643,015 | 7/1997 | Wakata | 439/201 |

*Primary Examiner*—Khiem Nguyen
*Attorney, Agent, or Firm*—Sughrue, Mion, Zinn, Macpeak & Seas, PLLC

[57] ABSTRACT

A connector coupling structure includes a first connector and a second connector which can be coupled to each other, each connector including: a housing having a plurality of terminal accommodating chambers formed therein and a housing surface, and an opening portion which is formed on a front end side of the housing surface being on an engaged side and forming an upper surface over the terminal accommodating chambers; the first connector including a projected main coupling portion arranged at a middle portion of the housing surface of the first connector; the second connector including a recessed main coupling receiving portion arranged at a middle portion of the housing surface of the second connector, in which the first and second connectors are coupled by engaging the main coupling portion with the main coupling receiving portion while causing the respective housing surfaces to confront each other; projected retaining portions arranged on the housing surface of the first connector; and recessed retaining portions respectively engageable with the projected retaining portions, the recessed retaining portions being arranged at corresponding positions in the housing surface of the second connector to the respective projected retaining portions.

16 Claims, 10 Drawing Sheets

CONNECTOR COUPLING STRUCTURE

BACKGROUND OF THE INVENTION

1. Field of the Invention

This invention relates to a connector coupling structure used for automobiles and the like. More particularly, this invention is directed to a connector coupling structure used for connecting the wires of a plurality of connecting terminals to a printed circuit on a board, particularly a flexible printed board (hereinafter referred to as "FPC" whenever applicable), while accommodating the plurality of connecting terminals within a housing.

2. Background

Various types of FPCs have heretofore been used in order to reduce the weight of electric devices mounted on automobiles and the like. In this conjunction, U.S. Pat. No. 5,051,100 and the like disclose that an FPC is electrically connected to connecting wires branched from a wiring harness through an FPC connector that has connecting terminals accommodated therein.

As shown in FIG. 10, an FPC connector includes a housing 32 and connecting terminals 30. The housing 32 has a plurality of terminal accommodating chambers 39 and a thick-walled hinged rear holder 37 that prevents the connecting terminals 30 from erroneously coming off from the rear. Each terminal accommodating chamber 39 has a portion which is notched to form an opening portion 33. Each connecting terminal 30 has an elastic contact portion. Thus, the FPC connector generally has the connecting terminals 30 fitted into the accommodating chambers 39 in advance prior to being assembled to an automobile or the like and is transported to an assembling plant under such condition to be subjected to an assembling operation in the plant.

However, since the opening portion 33 extends over the upper surfaces of the terminal accommodating chambers 39, a part of a connecting terminal 30 is exposed from the opening portion 33 with the connecting terminal 30 accommodated within the corresponding terminal accommodating chamber 39. Therefore, there is a possibility that the contact portion of the connecting terminal 30 will be damaged by, e.g., the exposed contact portion of the connecting terminal 30 coming in contact with or colliding with other parts and the like during transportation.

In order to avoid such contact and collision, a cover 34 for covering the opening such as shown, e.g., in FIG. 11 is put. In this case, the connecting terminal 30 is protected by putting the cover 34 over the opening portion from the front of the housing 32 with the connecting terminal 30 having the connecting wire 31 connected thereto being accommodated within the terminal accommodating chamber 39.

Therefore, in the aforementioned connector, the cover 34 must be put on every time the connector is transported, which in turn has imposed the problem of making the connector expensive in addition to the fact that the cover 34, being disposable, is uneconomical.

In order to overcome this problem, the following connector coupling structure is available. The connector coupling structure includes two connectors, each having an opening portion. When coupled, the respective opening portions are caused to confront each other so as to protect connecting terminals exposed from the openings. This structure dispenses with a cover, which hence contributes to curtailing the cost of manufacture.

FIGS. 12 and 13 are a plan view and a front view of one of the two connectors used in this structure. This connector

35 is a hollowed rectangular solid having a plurality of terminal accommodating chambers 39. Each terminal accommodating chamber 39 has a connecting terminal 30 fitted thereinto, the connecting terminal 30 having a connecting wire 31 connected to the rear end thereof. Therefore, the front end side of each terminal accommodating chamber 39 is directed frontwardly (the lower side as viewed in FIG. 12), and the rear end side of each terminal accommodating chamber 39 is directed rearwardly (the upper side as viewed in FIG. 12).

A housing surface 36 on the coupling side, which forms an upper surface over the terminal accommodating chambers 39, has a band-like shape extending in a horizontal direction that is orthogonal to the axial direction of the connector 35. An opening portion 38 is formed on the front end side of the housing surface 36. Further, a thick-walled hinged rear holder 37 is formed on the rear end side. The hinged rear holder 37 prevents the connecting terminals 30 from erroneously coming off from the rear.

Further, a projected main coupling portion 5 is arranged in the middle of the housing surface 36, and a main notched portion 6 is arranged on a hinged rear holder 37 portion behind the main coupling portion 5.

FIGS. 14 and 15 are a plan view and a front view of the other connector of the two connectors used in the aforementioned structure. This connector 40 is a hollowed rectangular solid having a plurality of terminal accommodating chambers 49. Each terminal accommodating chamber 49 has a connecting terminal 30 fitted thereinto. The connecting terminal 30 has a connecting wire 31 connected to the rear end thereof.

A housing surface 41 on the coupling side, which forms an upper surface over the terminal accommodating chambers 49, has a band-like shape extending in a horizontal direction that is orthogonal to the axial direction of the connector 40. An opening portion 48 is formed on the front end side of the housing surface 41. Further, a thick-walled hinged rear holder 42 is formed on the rear end side. The hinged rear holder 42 prevents the connecting terminals 30 from erroneously coming off from the rear.

Further, a recessed main coupling receiving portion 15 is arranged in the middle of the housing surface 41, and a main projected portion 16 is arranged on a hinged rear holder 42 portion behind the main coupling receiving portion 15.

A procedure for coupling the two connectors will be described next. First, the connectors 35, 40 are positioned so that the respective housing surfaces 36, 41 thereof are caused to confront each other. Then, by sliding either the connector 35 rearwardly or the connector 40 frontwardly, the main coupling portion 5 can be fitted into the main coupling receiving portion 15.

Therefore, both connectors 35, 40 can be coupled to each other as shown in FIG. 16. Accordingly, the connectors 35, 40 are connected with the respective openings 38, 48 arranged face to face inwardly. Hence, the respective connecting terminals 30, 30 are not exposed, which in turn contributes to preventing other parts and the like from coming in contact with or colliding with the contact portions and the like of the connecting terminals during transportation.

However, in the aforementioned connector, if an external force such as shown by the arrow R in FIG. 17 is applied to at least one of the connectors 35, 40 that are so connected as shown in FIG. 17, e.g., to the connector 35, then, the connector 35 is displaced by turning about the main coupling portion 5. From this arises a problem that both connectors 35, 40 are uncoupled or damaged.

In addition, the application of such external force is caused frequently during handling of connectors, not by the connecting wires being pulled, etc. A solution to this problem has long been called for.

SUMMARY OF THE INVENTION

The invention has been made to overcome the aforementioned problems and shortcomings. The object of the invention is, therefore, to provide a connector coupling structure in which even if an external force is applied to at least one of a pair of connectors, such one of the connectors is not displaced by turning relative to the other connector, so that both connectors can maintain the stably connected condition and hence the connecting terminals can be reliably prevented, from being damaged.

The above object of the invention is achieved by a connector coupling structure in which a pair of connectors are coupled to each other. Each of the pair of connectors has an opening portion on a front end side of a housing surface that is on an engaged side, the housing surface forming upper surfaces of a plurality of terminal accommodating chambers. A projected main coupling portion is arranged in the middle of the housing surface of one of the connectors, and also a recessed main coupling receiving portion is arranged in the middle of the housing surface of the other connector. Both connectors are coupled by engaging the main coupling portion with the main coupling receiving portion while causing the respective housing surfaces to confront each other. In such connector coupling structure, projected retaining portions are arranged on the housing surface of the one of the connectors, and also recessed retaining portions respectively engageable with the projected retaining portions are arranged at corresponding positions in the housing surface of the other connector.

Further, the above object of the invention can be achieved by a pair of connectors coupled to each other. Each of the pair of connectors has an opening portion on a front end side of a housing surface that is on an engaged side, the housing surface forming upper surfaces of a plurality of terminal accommodating chambers. A projected main coupling portion is arranged in the middle of the housing surface of one of the connectors, and also a recessed main coupling receiving portion is arranged in the middle of the housing surface of the other connector. Both connectors are coupled by engaging the main coupling portion with the main coupling receiving portion while causing the respective housing surfaces to confront each other. In such a connector coupling structure, a projected retaining portion and a recessed retaining portion are arranged on one side and on the other side of the housing surface of the one of the connectors, and also a recessed retaining portion engageable with the projected retaining portion and a projected retaining portion engageable with the recessed retaining portion are arranged at a corresponding position on the one side and at a corresponding position on the other side of the housing surface of the other connector.

Further, the above object can be achieved by a connector coupling structure in which the projected retaining portions have outer circumferential walls having the same transverse cross section, each outer circumferential wall having such a shape as to expand from a proximal end portion toward a distal end portion thereof, and the recessed retaining portions have inner circumferential walls slidably engageable with the outer circumferential walls of the projected retaining portions.

In addition, at least a part of the outer circumferential wall of each projected retaining portion is curved or linear.

Further, the above object can be achieved by a connector coupling structure in which the connectors include hinged rear holders, respectively, and notched portions are arranged on a portion extending to the rear end sides of the terminal accommodating chambers from the projected retaining portions or the recessed retaining portions of the hinged rear holder of the one of the connectors.

Further, the above object can be achieved by a connector coupling structure in which notched portions are arranged on a portion extending to the rear end sides of the terminal accommodating chambers from the projected retaining portions or the recessed retaining portions of the hinged rear holder of the one of the connectors, and also projected portions corresponding to the notched portions are arranged on the hinged rear holder of the other connector.

According to the connector coupling structure of the invention, projected retaining portions are arranged on a housing surface of one of the connectors, and also recessed retaining portions respectively engageable with the projected retaining portions are arranged at the corresponding positions in a housing surface of the other connector, or a projected retaining portion and a recessed retaining portion are arranged on one side and on the other side of a housing surface of one of the connectors, respectively, and also a recessed retaining portion engageable with the projected retaining portion and a projected retaining portion engageable with the recessed retaining portion are arranged at a corresponding position on the one side and at a corresponding position on the other side of a housing surface of the other connector, respectively.

Therefore, both integrally coupled connectors are coupled at a total of three points at a pair of projected retaining portions and at a pair of recessed portions that are arranged on both sides on the housing surface so as to be symmetrical with respect to the main coupling portion or the main coupling receiving portion on the housing surface, in addition to the coupling of the main coupling portion to the main coupling receiving portion in the middle of the housing surface. Accordingly, both connectors are reliably prevented from being relatively displaced by turning by an external force. Hence, stable and strong coupling can be obtained.

According to the connector coupling structure of the invention, the projected retaining portions have the same transverse cross section and have outer circumferential walls, each outer circumferential wall having such a shape as to expand from the proximal end portion toward the distal end portion thereof, and the recessed retaining portions have inner circumferential walls that are slidably engageable with the outer circumferential walls of the projected retaining portions.

Therefore, displacements and the like in vertical directions with respect to the housing surfaces are regulated by the outer circumferential walls of the projected retaining portions having been slidably engaged with the inner circumferential walls of the recessed retaining portions, each outer circumferential wall having such a cross section as to expand from the proximal end portion of the projected retaining portion toward the distal end portion thereof. Accordingly, the floating and collapsing of both connectors relative to each other as well as the warping of the rear holders and the like can be prevented.

Further, at least a part of the outer circumferential wall of each projected retaining portion is curved. Therefore, a local stress concentration due to an external force can be avoided, and also wear of the slidably engaging surfaces at the time of coupling the connectors can be minimized. Further, at least a part of the outer circumferential wall of each projected retaining portion is linear. Slidability at the time of slidably engaging the connectors can be improved.

Further, in one embodiment notched portions are arranged on a portion extending to the rear end sides of the terminal accommodating chambers from either the projected retaining portions or the recessed retaining portions of the hinged rear holder of one of the connectors. Therefore, the recessed retaining portions or the projected retaining portions of the other connector are allowed to pass by easily at the time of slidably coupling the connectors.

Further, in one embodiment notched portions are arranged on a portion extending to the rear end sides of the terminal accommodating chambers from either the projected retaining portions or the recessed retaining portions of the hinged rear holder of one of the connectors, and also projected portions corresponding to the notched portions are arranged on the hinged rear holder of the other connector.

Therefore, the projected portions are fitted into the corresponding notched portions at the time of coupling the connectors, which in turn allows the mutually coupled condition of both connectors to be further stabilized and consolidated.

DETAILED DESCRIPTION OF THE PREFERRED EMBODIMENTS

A connector coupling structure, which is a first mode of embodiment of the invention, will now be described in detail with reference to FIGS. 1 to 5.

Figure 1:
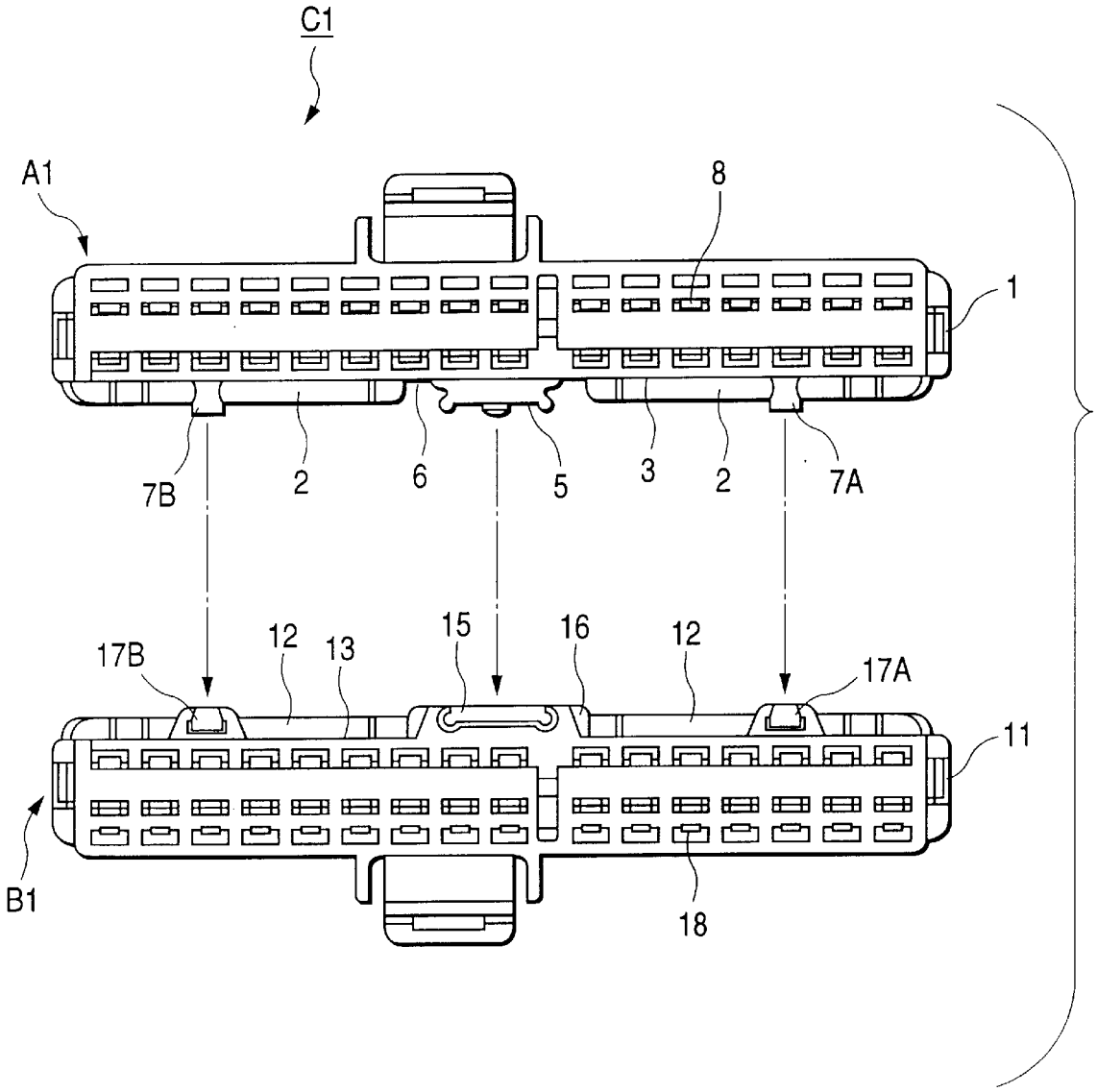
FIG. 1 is an exploded front view showing a connector coupling structure, which is a first mode of embodiment of the invention.
Figure 2:
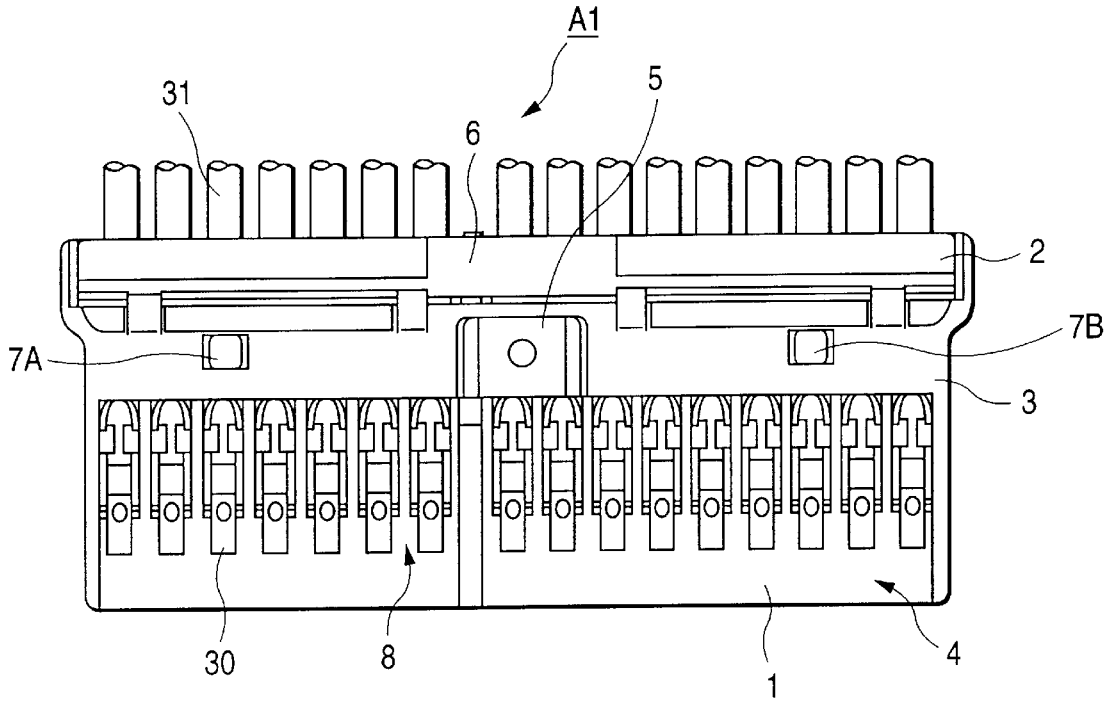
FIG. 2 is a plan view of a first connector shown in FIG. 1.

As shown in FIG. 1, an integrally coupled connector C1 is formed by coupling a first connector A1 and a second connector B1 for FPCs. The first connector A1 has connecting terminals 30 accommodated within a plurality of terminal accommodating chambers 8 that are formed within a hollowed rectangular solid as shown in FIG. 2, the connecting terminals 30 being connected to the front ends of connecting wires 31.

A housing surface 3 on the coupling side, which forms an upper surface over the terminal accommodating chambers 8, has such a band-like shape as to extend across the width of the first connector A1. An opening portion 4 is formed so as to extend from this housing surface 3 toward the front end. On the rear side is a thick-walled hinged rear holder 2 that prevents the connecting terminals 30 from erroneously coming off from the rear. Further, a projected main coupling portion 5 is disposed in the middle of the housing surface 3, and a main notched portion 6 is formed in a part of the hinged rear holder 2 behind the main coupling portion 5.

Figure 5:
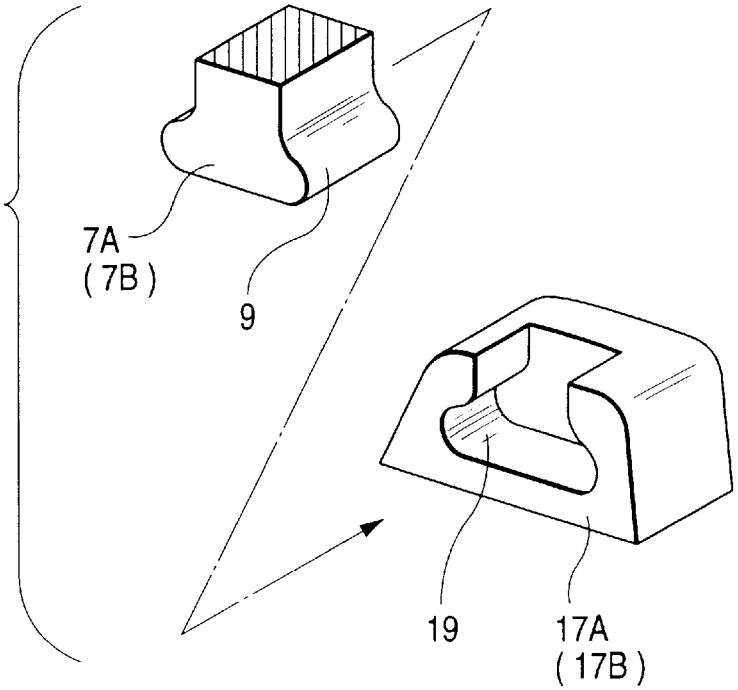
FIG. 5 is an operational diagram illustrative of sliding engagement between a projected retaining portion and a recessed retaining portion shown in FIG. 1.

Further, a pair of projected retaining portions 7A, 7B are symmetrically arranged on both sides of the main coupling portion 5 of the housing surface 3. As shown in FIG. 5, these projected retaining portions 7A, 7B have the same cross section and have outer circumferential walls 9 that extend in a sliding direction. Each outer circumferential wall 9 is so shaped as to expand from the proximal end portion toward the distal end portion thereof.

Figure 3:
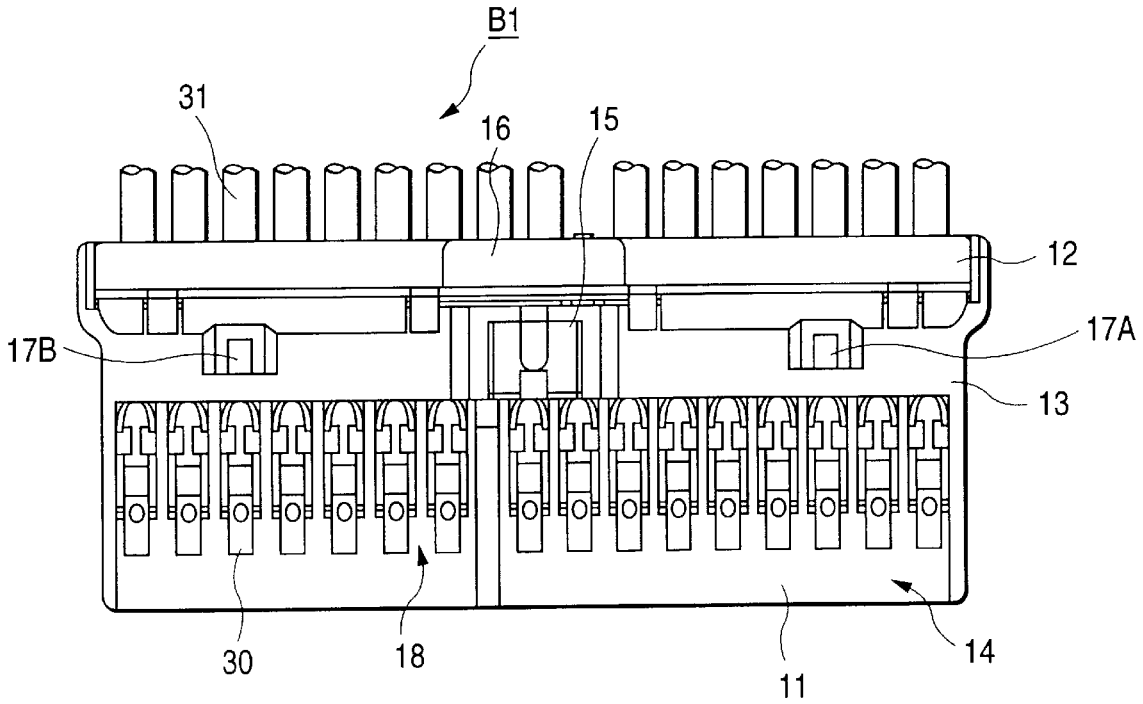
FIG. 3 is a plan view of a second connector shown in FIG. 1.

Then, as shown in FIG. 3, the second connector B1 has connecting terminals 30 accommodated within a plurality of terminal accommodating chambers 18 formed within a housing 11 of a hollowed rectangular solid, the connecting terminals 30 being connected to the front ends of connecting wires 31. A housing surface 13 on the coupling side, which forms an upper surface over the terminal accommodating chambers 18, has such a band-like shape as to extend across the width of the second connector B1.

Further, an opening portion 14 is formed so as to extend from this housing surface 13 toward the front end. On the rear side is a thick-walled hinged rear holder 12 that prevents the connecting terminals 30 from erroneously coming off from the rear. Further, a recessed main coupling receiving portion 15 is disposed in the middle of the housing surface 13, and a main projected portion 16 is formed in a part of the hinged rear holder 12 behind the main coupling receiving portion 15.

Further, a pair of recessed retaining portions 17A, 17B are symmetrically arranged on both sides of the main coupling receiving portion 15 of the housing surface 13. The recessed retaining portions 17A, 17B are engageable with the pair of projected retaining portions 7A, 7B, respectively. As shown in FIG. 5, these recessed retaining portions 17A, 17B have inner circumferential walls 19 that are slidably engageable with the outer circumferential walls 9 of the projected retaining portions 7A, 7B of the first connector A1.

A procedure for coupling the coupled connector C1 will be described next. First, as shown in FIG. 1, the first and second connectors A1, B1 are positioned so that the housing surfaces 3, 13 thereof confront each other. That is, the main coupling portion 5, the projected retaining portion 7A, and the projected retaining portion 7B are brought into contact with the main coupling receiving portion 15, the recessed retaining portion 17A, and the recessed retaining portion 17B, respectively, while positioned so as to confront each other.

Figure 4:
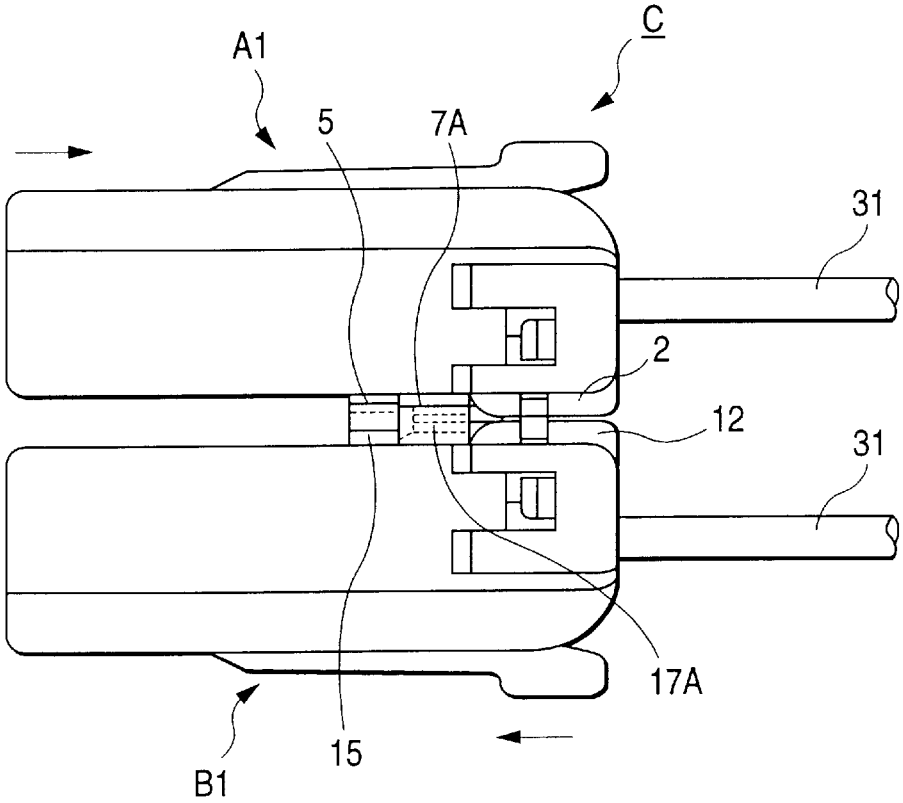
FIG. 4 is a side view showing a coupled condition of the connectors shown in FIG. 1.

Then, as shown in FIG. 4, e.g., the second connector B1 is moved frontwardly with respect to the first connector A1, or the first connector A1 is moved rearwardly with respect to the second connector B1. Such relative movement allows the main coupling portion 5 to pass by the main notched portion 6 to thereby engage with the main coupling receiving portion 15. At the same time, the recessed retaining portions 17A, 17B engage with the corresponding projected retaining portions 7A, 7B.

Therefore, as a result of the engagement at these three points, the first connector and second connectors A1, B1 are coupled to each other, so that the process of assembling the integrally coupled connector C1 is completed. Further, at the same time, the main projected portion 16 is fitted into the main notched portion 6, so that the coupled condition is further stabilized.

As described above, the connector coupling structure according to this mode of embodiment in which the first and second connectors A1, B1 are coupled to each other with the main coupling portion 5 and the main coupling receiving portion 15 in the middle of the housing surfaces 3, 13 fitted into each other, and at the other two points, which are at the pair of projected retaining portions 7A, 7B and the recessed retaining portions 17A, 17B that are symmetrically arranged on both sides of the main coupling portion 5 and the main coupling receiving portion 15.

Therefore, even if an external force is applied to either one of the first and second connectors A1, B1, there is no likelihood that one of the connectors will be displaced by turning relative to the other connector nor is there any likelihood that both connectors A1, B1 easily come off erroneously. Hence, a stable coupled condition of the two connectors can be obtained.

Further, the projected retaining portions 7A, 7B have the outer circumferential walls 9 that expand from the proximal end portion on the housing surface 3 to the distal end portion thereof, and the recessed retaining portions 17A, 17B have the inner circumferential walls 19 that are slidably engageable with the projected retaining portions 7A, 7B. Therefore, displacements and the like in vertical directions with respect to the housing surfaces 3, 13 are regulated in particular. That is, the floating and collapsing of both connectors A1, B1 relative to each other in the coupled condition as well as the warping of the rear holders and the like can be prevented.

Further, with respect to the contour of the transverse sectional surface of each of the projected retaining portions 7A, 7B, at least a part of the distal end portion of the outer circumferential wall 9 is made curved, so that a local stress concentration due to an external force can be avoided, and wear on the slidably engaging surfaces at the time of coupling the connectors can be minimized. Further, at least a part of the proximal end portion of the outer circumferential wall 9 is made linear, slidability at the time of slidably engaging the surfaces can be improved.

Further, the connector coupling structure according to this mode of embodiment provides the advantage of preventing damage of the connecting terminals during transportation in particular. The first and second connectors can be uncoupled with ease at the time of fitting and connecting the first and second connectors independently to mating connectors or the like after being transported.

On the other hand, the connector coupling structure according to this mode of embodiment can also be applied to a case where the first and second connectors are used as a single connector without being uncoupled even after being transported. That is, an FPC or a rigid circuit board that is arranged in a mating connector or the like may be fitted and connected to the opening portion of such single connector.

It may be noted that the invention is not limited to the aforementioned mode of embodiment. In the aforementioned mode of embodiment, the two projected retaining portions 7A, 7B are arranged on the housing surface 3 of the first connector A1 that has the projected main coupling portion 5, and the two recessed retaining portions 17A, 17B are arranged in the housing surface 13 of the second connector B1 that has the recessed main coupling receiving portion 15.

However, as another mode of embodiment, it may be constructed so that, for example, two recessed retaining portions 17A, 17B are arranged on the housing surface 3 of a first connector A that has the projected main coupling portion 5, and that two projected retaining portions 7A, 7B are arranged on the housing surface 13 of a second connector B that has the recessed main coupling receiving portion 15.

Or, a single projected retaining portion 7A and a single recessed retaining portion 17B may be arranged on the housing surface 3 of the first connector A that has the projected main coupling portion 5, and a single recessed retaining portion 17A and a single projected retaining portion 7B may be arranged on the housing surface 3 of the second connector B that has the recessed main coupling portion 15.

A connector coupling structure, which is a second mode of embodiment of the invention, will be described next with respect to FIGS. 6 to 9.

Figure 6:
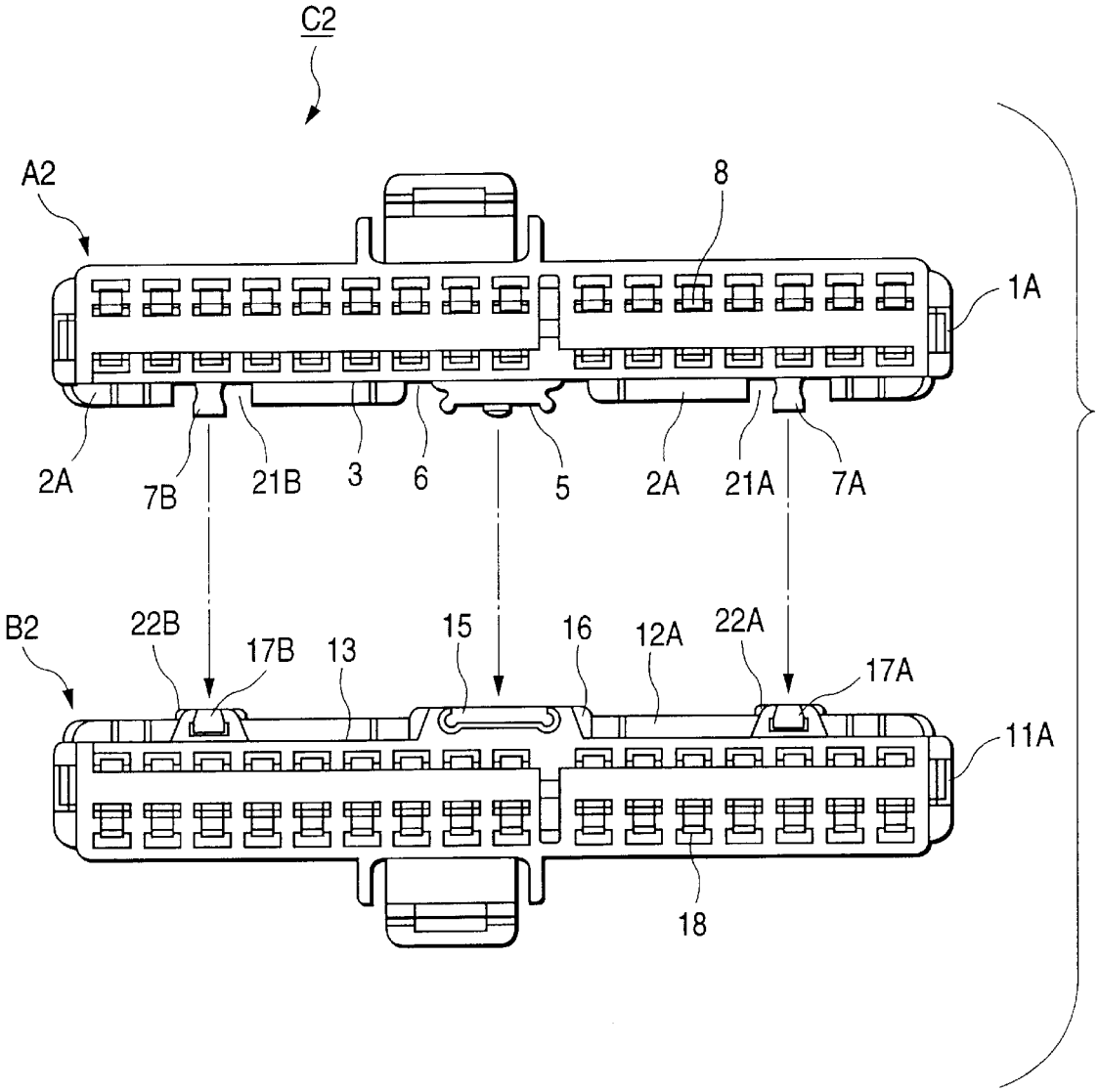
FIG. 6 is an exploded front view showing a connector coupling structure, which is a second mode of embodiment of the invention.
Figure 7:
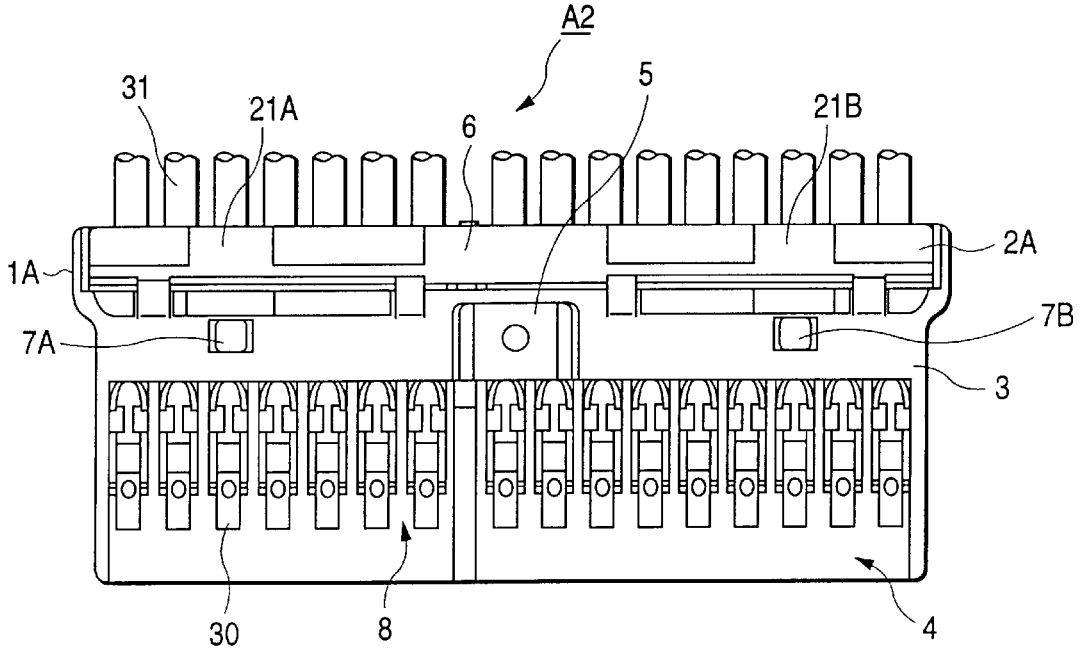
FIG. 7 is a plan view of a first connector shown in FIG. 6.

In addition to the construction of the aforementioned first mode of embodiment, the second mode of embodiment has, as shown in FIGS. 6 and 7, notched portions 21A, 21B in a portion extending to the rear end sides of the terminal accommodating chambers 8 from the projected retaining portions 7A, 7B of a hinged rear holder 2A of a first connector A2. These notched portions 21A, 21B help the recessed retaining portions 17A, 17B of a second connector B2 pass by easily at the time of slidably coupling both connectors A2, B2.

Figure 8:
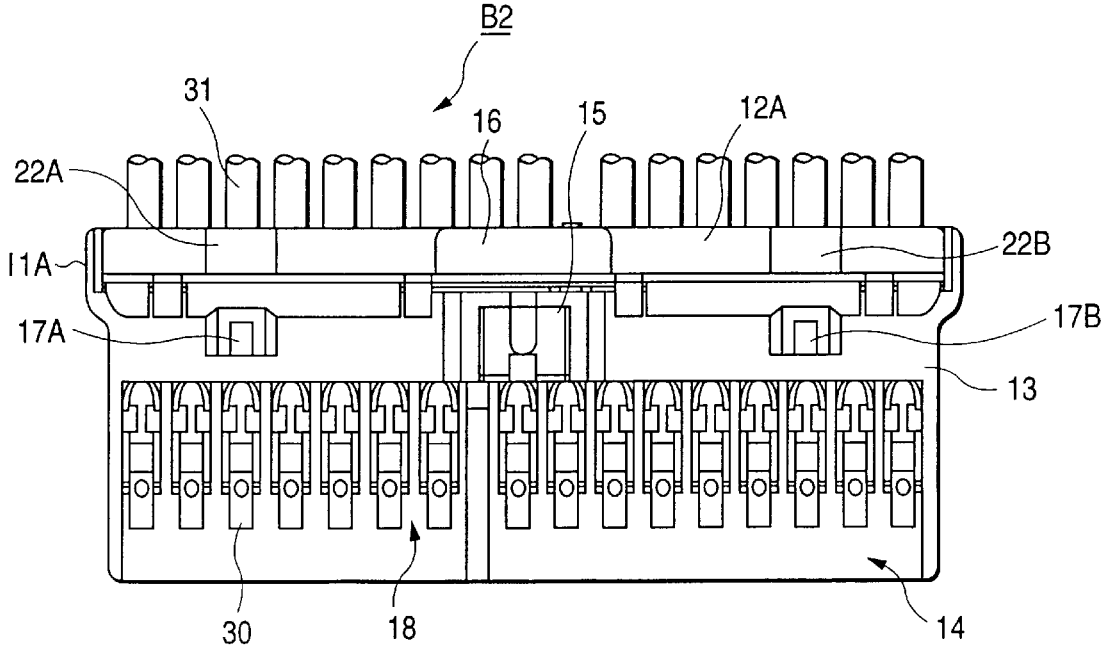
FIG. 8 is a plan view of a second connector shown in FIG. 6.

Further, as shown in FIGS. 6 and 8, projected portions 22A, 22B are arranged on a portion extending to the rear end sides of the terminal accommodating chambers 18 from the recessed retaining portions 17A, 17B of a hinged rear holder 12A of the second connector B2. These projected portions 22A, 22B are fitted into the corresponding notched portions 21A, 21B of the first connector A2 at the time both connectors A2, B2 have been completely coupled, so that the coupled condition between both connectors is further stabilized and consolidated.

A procedure for coupling a coupled connector C2 will be described next. First, as shown in FIG. 6, the first and second connectors A2, B2 are positioned so that the housing surfaces 3, 13 thereof confront each other. That is, the main coupling portion 5, the projected retaining portion 7A, the projected retaining portion 7B are brought into contact with the main coupling receiving portion 15, the recessed retaining portion 17A, and the recessed retaining portion 17B, respectively, while positioned so as to confront each other.

Figure 9:
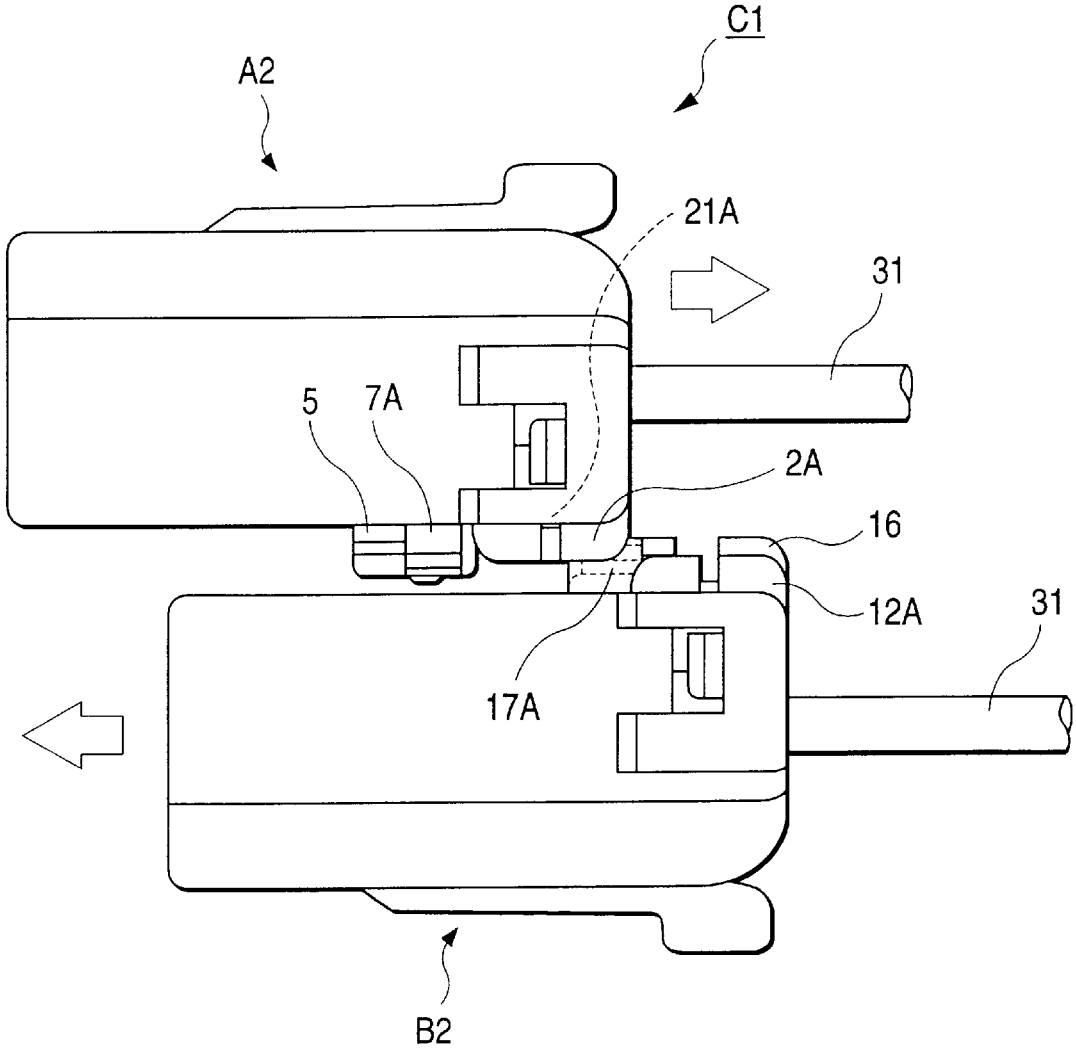
FIG. 9 is a side view showing a condition in which the connectors shown in FIG. 6 are in the course of being coupled to each other.
Figure 10:
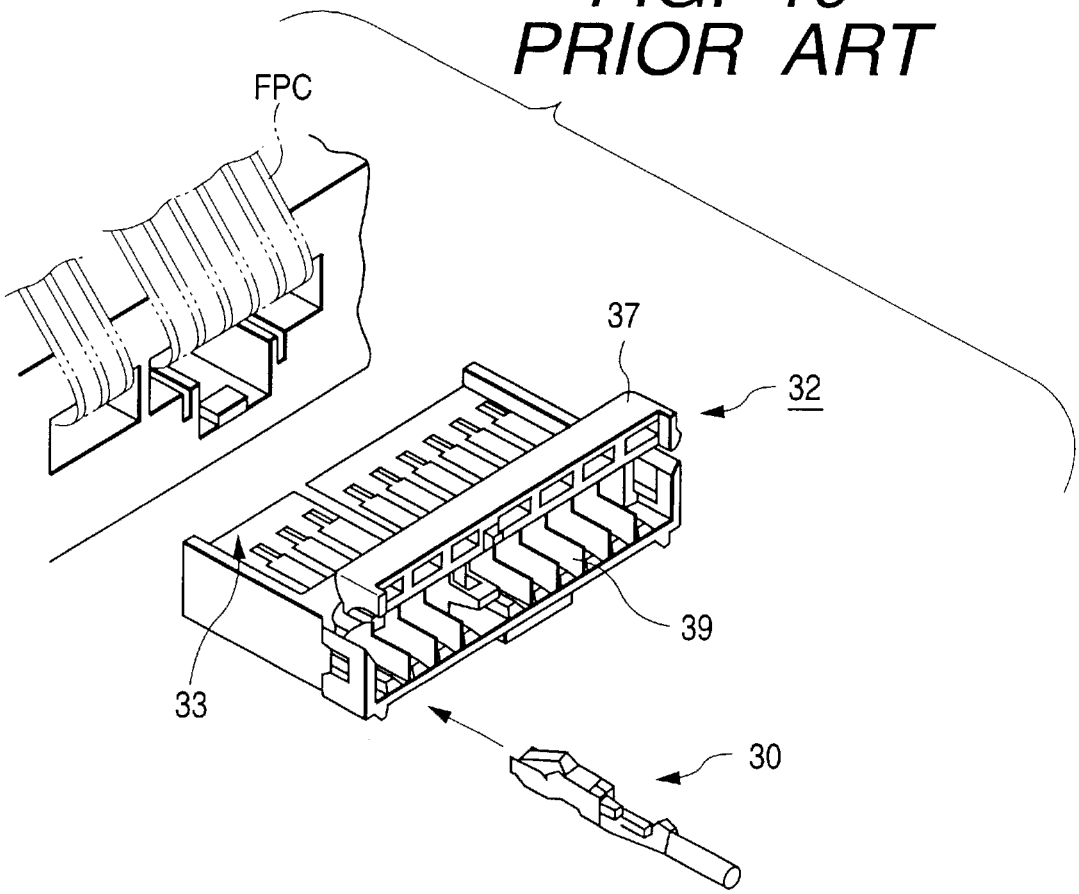
FIG. 10 PRIOR ART
FIG. 10 is a perspective view showing an example of a conventional FPC connector.
Figure 11:
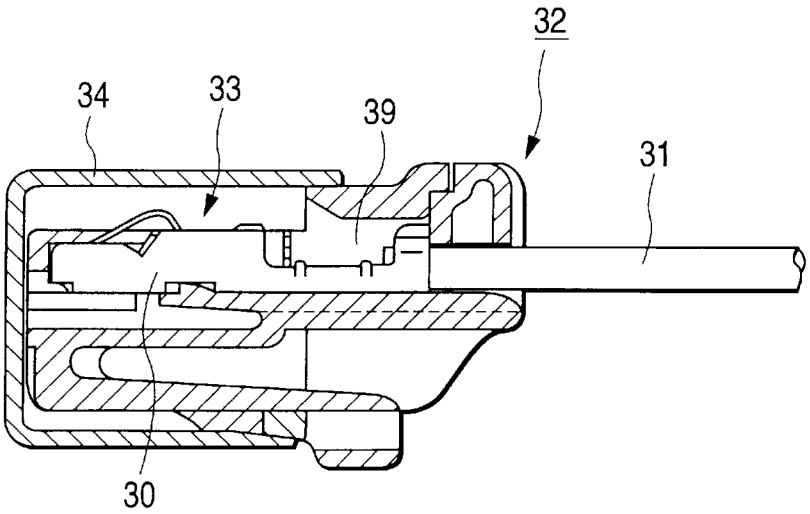
FIG. 11 PRIOR ART
FIG. 11 is a sectional view showing a condition in which a cover is put on the conventional connector.
Figure 12:
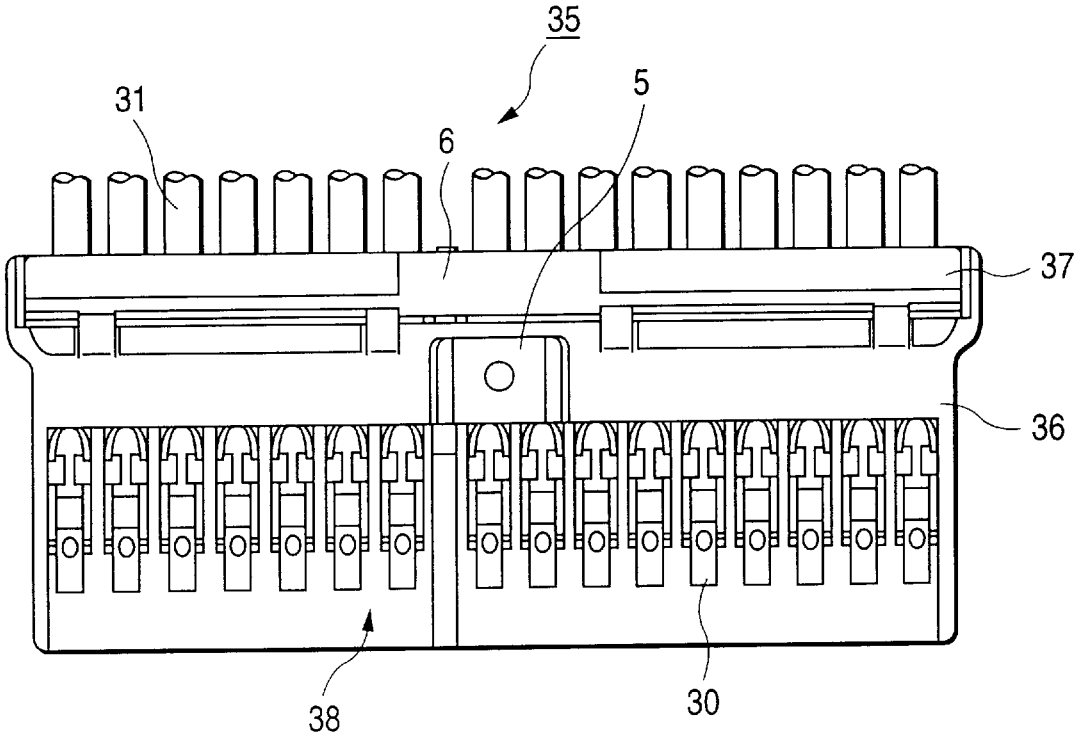
FIG. 12 PRIOR ART
FIG. 12 is a plan view showing one of the connectors of the conventional coupled connector.
Figure 13:
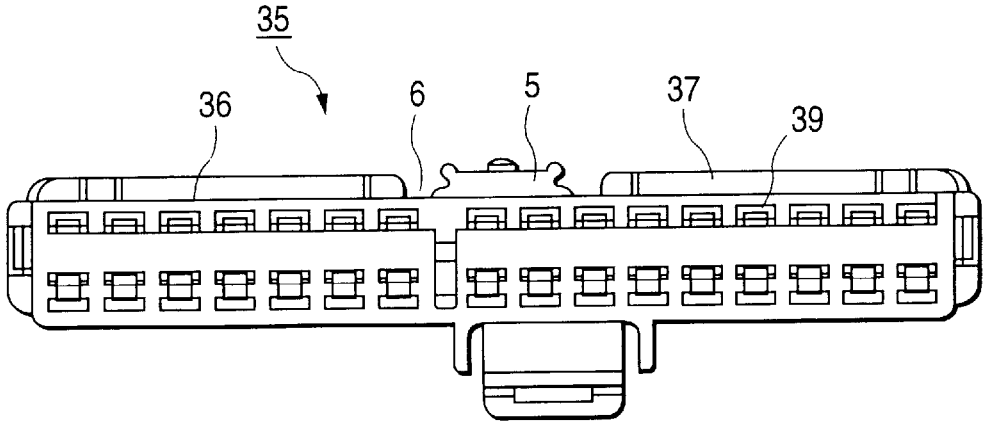
FIG. 13 PRIOR ART
FIG. 13 is a front view of the connector shown in FIG. 12.
Figure 14:
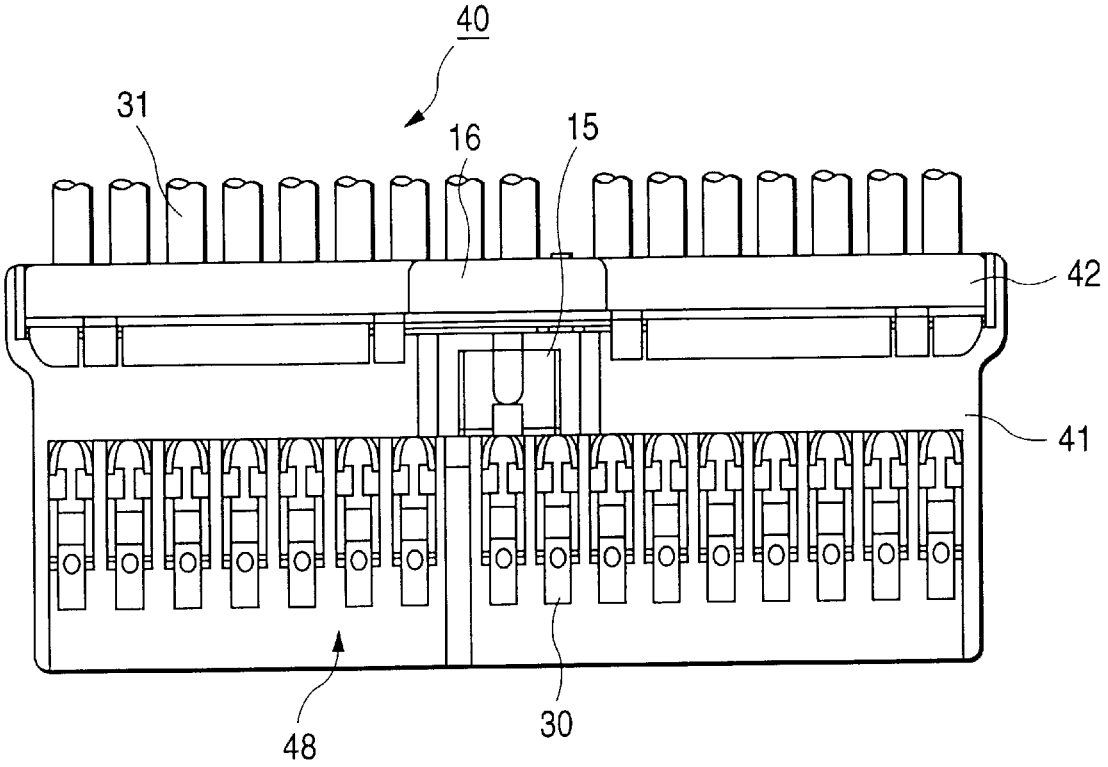
FIG. 14 PRIOR ART
FIG. 14 is a plan view showing the other connector of the conventional coupled connector.
Figure 15:
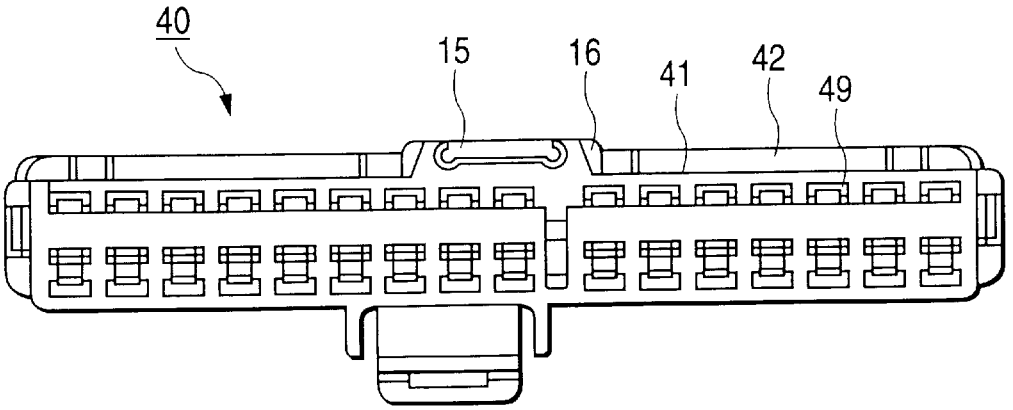
FIG. 15 PRIOR ART
FIG. 15 is a front view of the connector shown in FIG. 14.
Figure 16:
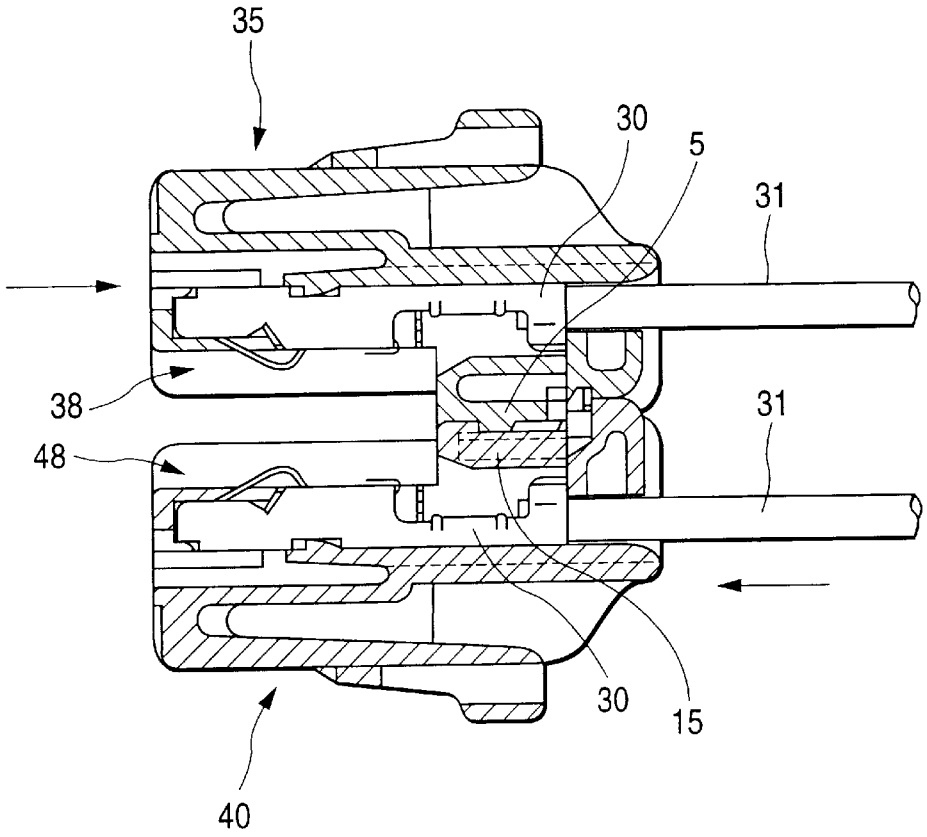
FIG. 16 PRIOR ART
FIG. 16 is a sectional view showing a coupled condition of the conventional coupled connector.
Figure 17:
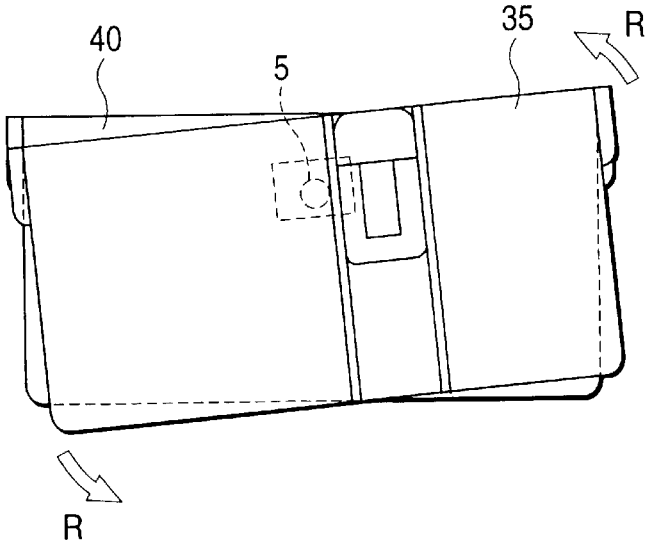
FIG. 17 PRIOR ART
FIG. 17 is a diagram illustrative of a condition in which an external force has been applied in FIG. 16.

Then, as shown in FIGS. 6 and 9, e.g., the second connector B2 is moved frontwardly with respect to the first connector A2, or the first connector A2 is moved backwardly with respect to the second connector B2. Such relative movement allows the main coupling portion 5 to pass by the main notched portion 6 to thereby engage with the main coupling receiving portion 15.

Further, at the same time, the recessed retaining portions 17A, 17B pass by the notched portions 21A, 21B of the hinged rear holder 2A of the first connector A2 without interference, so that the recessed retaining portions 17A, 17B engage with the corresponding projected retaining portions 7A, 7B, respectively. Therefore, the recessed retaining portions 17A, 17B do not come in contact with or collide with the hinged rear holder 2A, which in turn contributes to facilitating the coupling operation and also prevents the recessed retaining portions 17A, 17B, the hinged rear holder 2A, and the like from being damaged.

Further, at the same time, the main projected portion 16 is fitted into the main notched portion 6, and also the projected portions 22A, 22B of the hinged rear holder 12A of the second connector B2 are fitted into the notched portions 21A, 21B of the hinged rear holder 2A, so that the coupled condition can be further stabilized and consolidated. Accordingly, the process of assembling the integrally coupled connector C2 is completed with the first and second connectors A2, B2 coupled to each other at these three points.

It may be noted that the invention is not limited to the aforementioned mode of embodiment. The invention may be applied to such an example in which the notched portions are arranged in the hinged rear holder 12A of the second connector B2 and in which the projected portions are arranged on the hinged rear holder 2A of the first connector A2.

As described above, according to the connector coupling structure of the invention, projected retaining portions are arranged on a housing surface of one of the connectors, and also recessed retaining portions respectively engageable with the projected retaining portions are arranged at the corresponding positions in a housing surface of the other connector, or a projected retaining portion and a recessed retaining portion are arranged on one side and on the other side of a housing surface of one of the connectors, respectively, and also a recessed retaining portion engageable with the projected retaining portion and a projected retaining portion engageable with the recessed retaining portion are arranged at a corresponding position on the one side and at a corresponding position on the other side of a housing surface of the other connector, respectively.

Therefore, the two connectors are coupled by the coupling of the pair of projected retaining portions to the pair of recessed retaining portions in addition to the coupling of the main coupling portion to the main coupling receiving portion in the middle of the housing surface. Accordingly, the connecting terminals can be reliably prevented from being damaged, and both connectors are reliably prevented from being relatively displaced by turning by an external force. Hence, stable and strong coupling can be obtained.

Further, the projected retaining portions have the same transverse cross section and have outer circumferential walls, each outer circumferential wall having such a shape as to expand from the proximal end portion toward the distal end portion thereof, and the recessed retaining portions have inner circumferential walls that are slidably engageable with the outer circumferential walls of the projected retaining portions.

Therefore, displacements and the like in vertical directions with respect to the housing surfaces are regulated by the outer circumferential walls of the projected retaining portions having been slidably engaged with the inner circumferential walls of the recessed retaining portions. Accordingly, the floating and collapsing of both connectors A2, B2 relative to each other as well as the warping of the rear holders and the like can be prevented.

Hence, both connectors that are coupled to each other during transportation are not easily uncoupled and, in addition, absence of the exposed portions of the connecting terminals contributes to reliably preventing the connecting terminals from being damaged.

Further, notched portions are arranged on a portion extending to the rear end sides of the terminal accommodating chambers from either the projected retaining portions or the recessed retaining portions of the hinged rear holder of one of the connectors. Therefore, the recessed retaining portions or the projected retaining portions of the other connector are allowed to pass by easily at the time of slidably coupling the connectors. Accordingly, there is no likelihood that the recessed retaining portions will come in contact with or collide with the hinged rear holder, which in turn contributes to facilitating the coupling operation, and preventing the recessed retaining portions, the hinged rear holder, and the like from being damaged.

Further, notched portions are arranged on a portion extending to the rear end sides of the terminal accommodating chambers from either the projected retaining portions or the recessed retaining portions of the hinged rear holder of one of the connectors, and projected portions corresponding to the notched portions are arranged on the hinged rear holder of the other connector. Therefore, the projected portions are fitted into the corresponding notched portions at the time of coupling the connectors, which in turn allows the mutually coupled condition of both connectors to be further stabilized and consolidated.

What is claimed is:

1. A connector coupling structure, comprising:

a first connector and a second connector which can be coupled to each other, each connector including:

a housing having a plurality of terminal accommodating chambers formed therein and a housing surface, and an opening portion which is formed on a front end side of the housing surface being on an engaged side and forming an upper surface over the terminal accommodating chambers;

the first connector including a projected main coupling portion arranged at a middle portion of the housing surface of the first connector;

the second connector including a recessed main coupling receiving portion arranged at a middle portion of the housing surface of the second connector, wherein the first and second connectors are coupled by engaging the main coupling portion with the main coupling receiving portion while causing the respective housing surfaces to confront each other;

projected retaining portions arranged on the housing surface of the first connector; and recessed retaining portions respectively engageable with the projected retaining portions, the recessed retaining portions being arranged at corresponding positions in the housing surface of the second connector to the respective projected retaining portions.

2. The connector coupling structure of claim 1, wherein the projected retaining portions have outer circumferential walls each having the same transverse cross section, the outer circumferential walls each having a shape to expand from a proximal end portion toward a distal end portion thereof, and the recessed retaining portions have inner circumferential walls slidably engageable with the outer circumferential walls of the projected retaining portions.

3. The connector coupling structure of claim 2, wherein at least a part of each of the outer circumferential walls is formed to curve.

4. The connector coupling structure of claim 2, wherein at least a part of the outer circumferential wall of each projected retaining portion is formed to be linear.

5. The connector coupling structure of claim 1, wherein the housing of the first connector comprises a first rear holder having the projected retaining portions, and wherein the housing of the second connector comprises a second rear holder having the recessed retaining portions.

6. The connector coupling structure of claim 5, further comprising notched portions which are arranged on portions extending to a rear end side of the terminal accommodating chambers from one of the projected retaining portions of the first rear holder and the recessed retaining portions of the second rear holder.

7. The connector coupling structure of claim 5, further comprising:

notched portions which are arranged on portions extending to a rear end side of the terminal accommodating chambers from one of the projected retaining portions of the first rear holder and the recessed retaining portions of the second rear holder; and projected portions which correspond to the notched portions and are arranged on one of the first rear holder and the second rear holder.

8. A connector coupling structure, comprising:

a first connector and a second connector which can be coupled to each other, each connector including:

a housing having a plurality of terminal accommodating chambers formed therein and a housing surface, and an opening portion which is formed on a front end side of the housing surface being on an engaged side and forming an upper surface over the terminal accommodating chambers;

the first connector including a projected main coupling portion arranged at a middle portion of the housing surface of the first connector;

the second connector including a recessed main coupling receiving portion arranged at a middle portion of the housing surface of the second connector, wherein the first and second connectors are coupled by engaging the main coupling portion with the main coupling receiving portion while causing the respective housing surfaces to confront each other;

a first projected retaining portion and a first recessed retaining portion arranged respectively on the housing surface of the first connector; and a second recessed retaining portion on the housing of the second connector, engageable with said first projected retaining portion and a second projected retaining portion on the housing of the second connector, engageable with the first recessed retaining portion.

9. The connector coupling structure of claim 8, wherein the first and second projected retaining portions have outer circumferential walls each having the same transverse cross section, the outer circumferential walls each having a shape to expand from a proximal end portion toward a distal end portion thereof, and the first and second recessed retaining portions have inner circumferential walls slidably engageable with the outer circumferential walls of the second and first projected retaining portions.

10. The connector coupling structure of claim 9, wherein at least a part of each of the outer circumferential walls is formed to curve.

11. The connector coupling structure of claim 9, wherein at least a part of the outer circumferential wall of each projected retaining portion is formed to be linear.

12. The connector coupling structure of claim 8, wherein the housing of the first connector comprises a first rear holder having the first projected retaining portion and the first recessed retaining portion, and wherein the housing of the second connector comprises a second rear holder having the second projected retaining portion and the second recessed retaining portion.

13. The connector coupling structure of claim 12, further comprising notched portions which are arranged on portions extending to the rear end side of the terminal accommodating chambers from the first projected retaining portion and the first recessed retaining portion of the first rear holder.

14. The connector coupling structure of claim 12, further comprising notched portions which are arranged on portions extending to the rear end side of the terminal accommodating chambers from the second projected retaining portion and the second recessed retaining portion of the second rear holder.

15. The connector coupling structure of claim 12, further comprising:

notched portions which are arranged on portions extending to the rear end side of the terminal accommodating chambers from the first projected retaining portion and the first recessed retaining portion of the first rear holder; and projected portions which corresponds to the notched portions and are arranged on the second rear holder.

16. The connector coupling structure of claim 12, further comprising:

notched portions which are arranged on portions extending to the rear end side of the terminal accommodating chambers from the second projected retaining portion and the second recessed retaining portion of the second rear holder; and projected portions which corresponds to the notched portions and are arranged on the first rear holder.

* * * * *